United States Patent [19]

Ziliani

[11] Patent Number: 4,478,428

[45] Date of Patent: Oct. 23, 1984

[54] FOLDING CART FOR SERVING MEALS OR THE LIKE

[75] Inventor: Franco Ziliani, Brescia, Italy

[73] Assignee: Norda Tubazioni S.P.A., Brescia, Italy

[21] Appl. No.: 333,521

[22] Filed: Dec. 22, 1981

[30] Foreign Application Priority Data

Jan. 9, 1981 [IT] Italy ..... 19074 A/81

[51] Int. Cl.[3] ..... B62B 3/02

[52] U.S. Cl. ..... 280/651; 108/111; 280/47.35

[58] Field of Search ..... 280/639, 641, 651, 652, 280/47.16, 47.34, 47.35, 47.18; 108/111, 115; 248/166

[56] References Cited

U.S. PATENT DOCUMENTS

| | | | |
|---|---|---|---|
| 3,074,734 | 1/1963 | Munson | 280/47.35 |
| 3,099,356 | 7/1963 | Burnett | 108/111 |
| 3,310,317 | 3/1967 | Luff | 280/47.34 |
| 3,436,092 | 4/1969 | Werner | 280/651 |
| 4,160,557 | 7/1979 | Taylor | 280/652 |
| 4,236,462 | 12/1980 | Berthier | 280/651 |

*Primary Examiner*—Joseph F. Peters, Jr.
*Assistant Examiner*—Joseph G. McCarthy
*Attorney, Agent, or Firm*—Guido Modiano; Albert Josif

[57] ABSTRACT

The cart comprises a frame including first and second uprights which are pivoted at their top ends for mutual rotation about a substantially perpendicular axis to their longitudinal direction and support a lower deck, which is pivotally connected, at a middle portion thereof, close to the bottom end of the second upright and slidably engages, at one end thereof, with the first upright, as well as an upper deck pivotally connected at one end to the first upright, and at a middle portion thereof, to one end of a rod-like body which is pivotally connected, with its other end, to a middle portion of the second upright.

7 Claims, 5 Drawing Figures

FOLDING CART FOR SERVING MEALS OR THE LIKE

BACKGROUND OF THE INVENTION

This invention relates to a folding cart for serving meals and the like.

Currently well known on the market are various types of folding carts, whereby the cart folding feature is attained in a large variety of ways.

In particular, it has been found that currently utilized methods of folding the cart are mostly complex and unstable ones, while they fail to provide a good compaction of the cart with appreciable reduction of its bulk.

Other known cart types, which afford a good compaction of the cart with a considerable reduction of its bulk, are generally based upon the principle that the cart composing decks should be half decks extending aligned to each other when the cart is in its unfolded condition, and folding like a book with the cart in the folded condition.

This approach, while solving the problem of bulk reduction, involves considerable constructional difficulties and leads to drastic limitations to the cart configuration, which is practically forced to a compulsory configuration, it being heavily dependent on the particular mechanisms required for folding and unfolding it.

SUMMARY OF THE INVENTION

This invention has for its primary object that of eliminating any prior drawbacks by providing a folding cart for serving meals, whereby, while using decks made up of whole elements requiring no dismounting to achieve the folded condition, the cart can be compacted in a most satisfactory way, the useful size of the cart being reducible to the dimensions dictated by the superimposition of the decks included in the cart structure.

It is another object of the invention to provide a folding cart, which is simple construction-wise and affords the possibility of effecting the folding and unfolding operations in an extremely rapid manner.

A further object of this invention is to provide a folding cart which, on account of its compactability, can be packaged into an extremely reduced volume, thus solving the cart transportation and storage problems.

Yet another object of this invention is to provide a cart which can be easily manufactured from elements and materials which are readily available on the market, and which can take various configurations, its aesthetic appearance not being dependent on the mechanisms employed for unfolding and folding it.

The aforesaid and other objects, such as will be apparent hereinafter, are all achieved by a folding cart for serving meals and the like, characterized in that it comprises a frame including first and second uprights pivotally connected at the top ends thereof for mutual rotation about a substantially perpendicular axis to the longitudinal direction of said uprights, there being also provided a lower deck, pivotally connected at a middle portion thereof to a point close to the bottom end of said second upright and adapted to slidably engage, at one end thereof, with said first upright, as well as an upper deck pivotally connected at one end to the first upright and, at a middle portion thereof, with one end of a rod-like body, said rod-like body being pivotally connected, at its other end, to a middle portion of said second upright.

BRIEF DESCRIPTION OF THE DRAWINGS

Further features and advantages of the invention will be more readily apparent from a detailed description of a folding cart for serving meals and the like, illustrated by way of example and not of limitation in the accompanying drawings, where.

DESCRIPTION OF THE PREFERRED EMBODIMENTS

Figure 1:
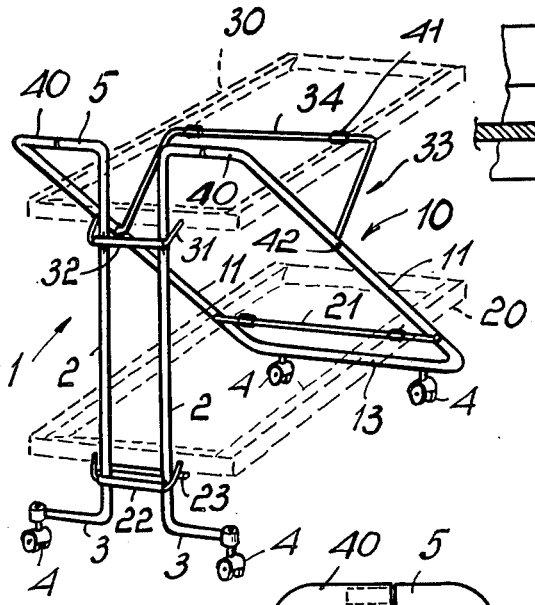
FIG. 1 is a schematical perspective view of this cart.

With reference to the drawing figures, the folding cart for serving meals and the like, according to the invention, comprises a first upright, generally indicated at 1, including a pair of elongated elements 2 arranged in side-by-side relationship. From the bottom ends of the elongated elements 2 there extend, in a perpendicular direction to the elongated elements 2, lower legs 3 aligned to each other and carrying conventional castor wheels 4. At their top ends, the elongated elements 2 have upper legs 5 extending aligned to each other and perpendicular to the elements 2, the upper legs 5 being pivotally connected, in a manner to be explained hereinafter, to a second upright 10.

The second upright 10 has a substantially U-like configuration with arms 11 pivoted to the legs 5 at upper portions 40 extending in a direction perpendicular to the lateral arms of the U-shape of the second upright for rotation about an axis extending substantially perpendicular to the longitudinal direction of the upright 1 and upright 10. As visible from the drawings the upper and lower legs 5, 3 of the first upright extend in diverging departing from said elements 2, whereas said upper portions 40 extend towards each other from said lateral arms of the second upright.

Advantageously, but not necessarily, both the upright 1 and upright 10 may be formed from tubular elements, and the mutual rotation of the two uprights is accomplished by means of a shank attached to one upright and introduced into the other upright interior.

The upright 10 has a coupling or central portion 13 for the arms 11 which extends substantially horizontally and is also provided with castor wheels 4.

The cart has a lower deck 20, preferbly but not necessarily of rectangular configuration, which is carried rotatably, at a middle portion thereof, by a crosspiece 21 interconnecting the arms 11 of the upright 10 and defining a rotation axis which extends substantially parallel to the rotation axis between the upright 1 and upright 10.

Figure 5:
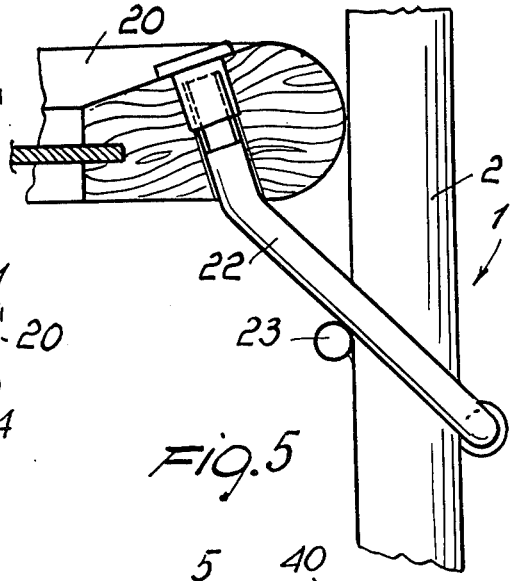
FIG. 5 is a detail view of the connection of the lower deck to the first upright.

The deck 20 engages, at an edge portion, slidably with the first upright 1, and in this embodiment as shown in FIG. 5, a bridge member 22 is provided which encircles externally the elongated elements 2 in a manner to allow its sliding movement between a lower end position at the level of the lower deck 20 and the upper end of the upright 1, while maintaining the connection therebetween.

Located near the bottom ends of the elongated elements 2 is a stop crosspiece 23 against which abuts the bridge 22 to define the lower arresting position for the the bridge 22, which position corresponds in practice to the level of the lower deck 20 when it is arranged in a horizontal plane.

The cart further comprises an upper deck 30, which is pivoted at an edge portion to the first upright 1 by means of a bracket element 31 made rigid with the deck 30 and pivotally engaging with a bushing 32 attached transversely to the elongated elements 2 and defining a rotation axis which likewise extends parallel to the of relative rotation between the upright 1 and upright 10.

Figure 2:
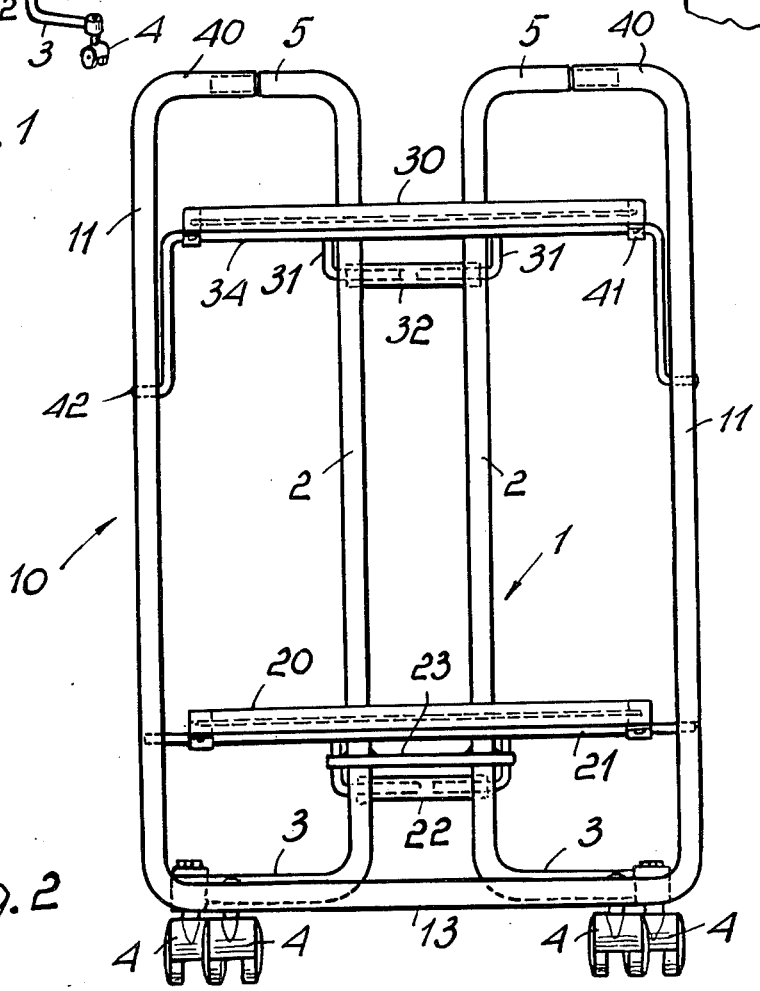
FIG. 2 is a front elevation view of this cart.

The upper deck 30 is pivoted, at a middle portion thereof, to a rod-like body 33, which is subtantially C-shaped and has its middle portion 34 pivotally engaged with the deck 30 and the free ends of its arms pivoted to a middle portion of the second upright 10, more precisely at a middle portion of the arms 11. As visible from the drawings the upper deck presents, at its lower side in the unfolded condition of the cart, hinge elements 41 permanently accomodating the middle portion 34 of the body 33 (FIGS. 2 and 3).

Figure 3:
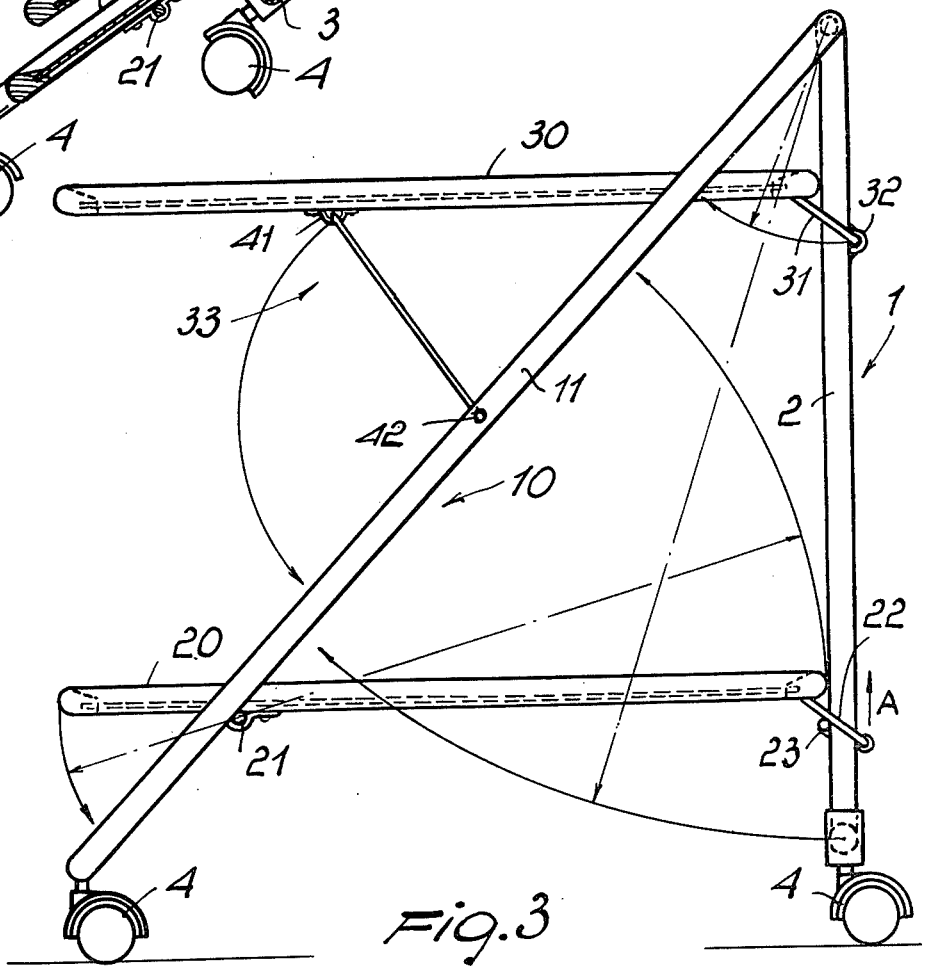
FIG. 3 is a side elevation view of this cart showing the rotational movements imparted to the individual component elements for the unfolding and folding operations.

By virtue of the couplings described hereinabove, the cart is enabled to take a stable unfolded position or attitude, as shown in FIG. 3, whereat the lower deck 20 extends substantially horizontally and is in practice supported between the crosspiece 21 and stop crosspiece 23, while the upper deck is also laid horizontal and supported through pivot points comprising the bushing 32 and the pivotal connection 41 of the middle portion 34 to the deck 30 and pivotal 42 connection of the arms of the rod-like body 33 to the second upright 10, which defines in practice a three pivoted point arc.

To fold the cart, that is to reduce its bulk dimensions, it will be sufficient to act on the bridge 22 such as to move it upwards along the first upright 1, as indicated by the arrow A in FIG. 3.

The upwards translation of the bridge 22, owing to the coupling system described above, produces a rotation of the lower deck 20 about the crosspiece 21 and rotation of the first upright 1 relatively to the second upright 10.

The rotation of the upright 1 relatively to the upright 10 first causes the upper deck 30 to move toward the front, which deck, being pivoted to the bushing 32, follows the arched path defined by the rod-like body 33 to reach the flat configuration of the cart.

Figure 4:
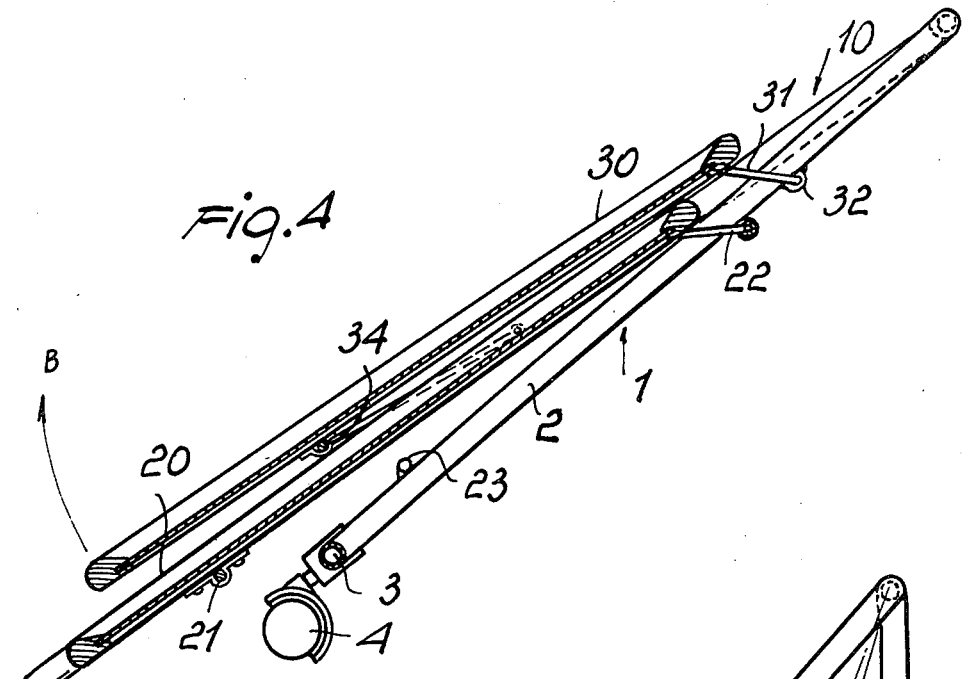
FIG. 4 shows, in side elevation, this cart in its folded condition.

In the folded position, as shown in FIG. 4, the decks 20 and 30 practically overlie each other and are positioned within the outline defined by the second upright 10, while the first upright 1 arranges itself side-by-side thereto.

In order to again unfold the cart, it will be sufficient to act upon the free end of the upper deck 30 such as to produce a rotational movement in the opposite direction to the folding one (arrow B in FIG. 4), thus causing the bridge 22 to slide in the direction opposite to arrow A in FIG. 3 along the first upright 1 until the bridge abuts against the crosspiece 23.

In the unfolded condition, the cart is highly stable and not liable to incidental folding because the weights applied on the decks will in practice contribute to holding the cart unfolded.

From the foregoing description, it will be apparent that the invention achieves its objects, and in particular the fact should be noted that the kinematic linkage utilized to unfold and fold the cart allow the designer to select from a large variety of configurations, thus solving the aesthetic problems connected with the design of such carts.

Moreover, an extremely important aspect is that the unfolding and folding are easily accomplished by the user, with the possibility of imparting to the cart provided with single piece decks a perfectly flat configuration in the folded condition.

The invention as described is susceptible to many modifications and variations without departing from the true scope of the instant inventive concept.

Furthermore, all of the details may be replaced with other technically equivalent elements.

In practicing the invention, the materials used, as well as the dimensions and contingent shapes, may be any suitable ones for the intended application.

I claim:

1. A folding cart comprising a pair of elongated elements extending substantially parallel to each other and forming a first upright, said elongated elements having at one end thereof upper legs extending aligned to each other and substantially perpendicular to said elongated elements, a second substantially U-like shaped upright having a bottom portion provided with castor wheels and lateral arms having upper portions extending substantially perpendicular to said lateral arms and aligned with said upper legs of the first upright and in pivotal engagement therewith thereby defining together with said upper legs a pivotal connection between said first and second uprights, said pivotal connection defining an axis of pivotal rotation in alignment with said upper legs and upper portions, a lower deck pivotally connected at a middle region thereof to lower portions of said lateral arms of said U-shaped second upright and slidably engaging, at an edge portion thereof, said first upright, as well as an upper deck having a bracket element rigid with an edge portion of said upper deck and inserted in a bushing rigidly carried on the elongated elements so as to form an articulation axis between upper deck and first upright, said upper deck having at a middle region thereof, at its lower side in the unfolded condition of the cart, hinge elements permanently accomodating a central portion of a U-like shaped rod-like element having lateral arms connected to said central portion, said lateral arms of said U-like shaped rod-like element being pivotally connected at an end thereof with middle portions of the lateral arms of said second U-shaped upright.

2. A folding cart according to claim 1, wherein said first and second uprights are defined by tubular elements and said upper legs present each a shank accomodatng therein a corresponding hollow end of said upper portions of the second upright and thereby forming a pivot axis between said first and second uprights.

3. A folding cart according to claim 1, wherein said upper legs of said first upright extend in diverging directions departing from said elongated elements and said upper portions of said second upright extend toward each other from said lateral arms of said second upright.

4. A folding cart according to claim 1, wherein said elongated elements presents at another end thereof lower legs extending aligned to each other in diverging directions from said elongated elements and substantially perpendicular to said elongated elements, said lower legs being provided with castor wheels.

5. A folding cart according to claim 1, wherein said lower deck is pivotally connected to a crosspiece fixedly connected with end portion thereof to said lateral arms of said second upright and extending substantially parallel to said central portion of the U-like shaped second upright.

6. A folding cart according to claim 1, wherein said lower deck is provided at said edge portion thereof with a bridge member slidably encicling the pair of elongated elements, said elongated elements being provided with a stop crosspiece for said bridge member.

7. A folding cart comprising a pair of elongated elements extending substantially parallel to each other and forming a first upright, said elongated elements having at one end thereof lower legs extending aligned to each other and substantially perpendicular to said elongated elements and being provided with castor wheels, and at another end thereof upper legs extending aligned to each other and substantially perpendicular to said elongated elements, a second U-like shaped upright having a central portion provided with castor wheels and lateral arms provided with upper portions extending substantially perpendicular to said lateral arms and aligned with said upper legs of the first upright and accomodating therein shank portions of said upper legs, thereby defining together with said upper legs a pivotal connection, a lower deck pivotally connected at a middle region thereof to a crosspiece fixedly connected with end portions thereof to lower portions of said lateral arms and extending substantially parallel to said central portion of said U-shaped second upright, said lower deck being provided at an edge portion thereof with a bridge member slidably encircling the pair of elongated elements, said elongated elements being provided with a stop crosspiece for said bridge member, as well as an upper deck having a bracket element rigid with an edge portion of said upper deck and inserted in a bushing rigidly carried on the elongated elements so as to form an articulation axis between upper deck and first upright, said upper deck having at a middle region thereof, at its lower side in the unfolded condition of the cart, hinge elements permanently accomodating a central portion of a U-like shaped rod-like element having lateral arms connected to said central portion and being pivotally connected at ends thereof to middle portions of the lateral arms of said second U-shaped upright.

* * * * *